US006033323A

United States Patent [19]

McCown

[11] Patent Number: 6,033,323

[45] Date of Patent: Mar. 7, 2000

[54] BATTING TRAINING DEVICE

[76] Inventor: Roger McCown, 987 N. Linden Dr., Alcoa, Tenn. 37701

[21] Appl. No.: 09/124,193

[22] Filed: Jul. 28, 1998

[51] Int. Cl.[7] ..... A63B 69/00

[52] U.S. Cl. ..... 473/424; 473/423; 273/335

[58] Field of Search ..... 473/26 E, 20.1, 473/29, 26, 7

[56] References Cited

U.S. PATENT DOCUMENTS

| | | | |
|---|---|---|---|
| 2,270,957 | 1/1942 | Mears | 473/424 |
| 3,011,784 | 12/1961 | Segretto | 473/423 |
| 3,214,166 | 10/1965 | Gauget | 473/424 |
| 3,531,115 | 9/1970 | Alexander | 473/424 |
| 3,788,297 | 1/1974 | Borst | 473/423 |
| 3,907,287 | 9/1975 | Fox et al. | 473/424 |
| 5,657,984 | 8/1997 | Leo | 124/20.1 |

*Primary Examiner*—Jeanette Chapman
*Assistant Examiner*—Mitra Aryanpour
*Attorney, Agent, or Firm*—Pitts & Brittian, P.C.

[57] ABSTRACT

A batting training device defined by a spherical member 15 having a through-opening 20 concentric with a central axis 22 and two elongated tether members 25 that pass through the through-opening 20. Each elongated tether 25 has a first end 34 secured to a handle 40 and a second end 36 secured to a securement member 45. The handles 40 are provided for being grasped by a coach or a training assistant (not shown). The securement member 45 is provided for securing the batting training device 10 to a stationary object such as a chain-link fence.

13 Claims, 3 Drawing Sheets

BATTING TRAINING DEVICE

DESCRIPTION

1. Technical Field

This invention relates to the field of sports training devices. More particularly, it relates to a batting training device for baseball and/or softball.

2. Background Art

One of the most difficult skills to learn and maintain, in the sport of baseball, is the correct bat swing. Batting practice, either using a live pitcher or a pitching machine is a necessary component of training. However, it is often desirable to supplement batting practice with a consistent, repeatable target. And, there are a number of swing, or batting training devices in the art useful for developing proper hand-to-eye coordination, and muscle memory. For instance, a tee is perhaps the most frequently used batting training device. Those skilled in the art recognize that a tee is a vertical support, of adjustable height, upon which a ball is placed in order to provide a stationary target, with the batter attempting to hit the ball off of the tee. While providing a good training device, a tee suffers from the shortcoming that it does not simulate a pitched ball and the ball must be retrieved and replaced on the tee. Another swing training device is an elongated, flexible shaft having a handle disposed at one end and a spherical ball simulator disposed at an opposite end. This device provides a stationary target and, also, allows the player's coach or other training assistant to move the ball simulator towards the player in a manner that approximates a pitched ball. However, as those skilled in the art recognize, the simulated pitch with this type of device has an arcuate path. An additional swing training device is defined by a ball anchored to the end of an elongated tether. A handle is provided at the other end of the tether. In use, the coach or other training assistant spins the ball in a circular path tangential to the batter, thus, simulating a pitched ball. While this device has the advantage of allowing the coach/training assistant to control the speed of the simulated pitch, again, the ball path is arcuate. Finally, while not a swing training device, there is a known toy that is used to propel an object from one player to a second player. This toy is defined by an object and two elongated tethers that pass through the center of the object, each tether having handles disposed at its respective ends. Two players grasp the handles at the respective ends of the two tethers. The first player snaps his handles away from each other, propelling the object towards the other player, who reciprocates by snapping her two handles away from each other prior to the object striking the handles, thus propelling the object back towards the first player; the object of the game being to keep the object in motion between the two players.

What has heretofore been missing from the art is a training device useful for training a proper bat swing that simulates the correct ball path of a pitched ball and yet doesn't require the ball to be retrieved when the ball is struck or when the ball is missed.

Accordingly, it is an object of the present invention to provide a batting training device that simulates the correct ball path of a pitched ball.

A further object of the present invention is to provide a batting training device that is readily portable and can be secured to a stationary object, such as a chain-link fence.

Another object of the present invention is to provide a batting training device in which a struck ball returns, in controlled fashion, to the training assistant.

Still yet another object of the present invention is to provide a batting training device in which the velocity of the simulated pitch is controllable.

Other objects and advantages over the prior art will become apparent to those skilled in the art upon reading the detailed description together with the drawings as described as follows.

DISCLOSURE OF THE INVENTION

In accordance with the various features of this invention, a batting training device offering advantages over the training devices known in the art is provided. The batting training device of the present invention is defined by a spherical member having a through-opening concentric with a central axis and two elongated tether members that pass through the through-opening. The through opening is preferably beveled at each end. The beveling eliminates a sharp edge that could potentially abrade the tethers as the spherical member is in motion. Each elongated tether has a first end and a second end. The first ends of the two tethers are secured to handles which are grasped by coach or a training assistant. The second end of each tether is secured to a releasable hook member for securing the batting training device to a stationary object such as a chain-link fence.

In the preferred embodiment, the batting training device is defined by a hollow, plastic, and preferably perforated, ball member having oppositely disposed hole members that provide a through-opening concentric with the central axis of the ball member. Plastic inserts are inserted into the hole members to prevent the edge of the hole members from abrading the tethers. The tethers are provided by two substantially equal lengths of polypropylene cord having first and second ends. Two rings are secured to the two first ends providing handles. The second end of each cord is secured to a double ended hook for securing the batting training device to a stationary object.

BEST MODE FOR CARRYING OUT THE INVENTION

Figure 1:
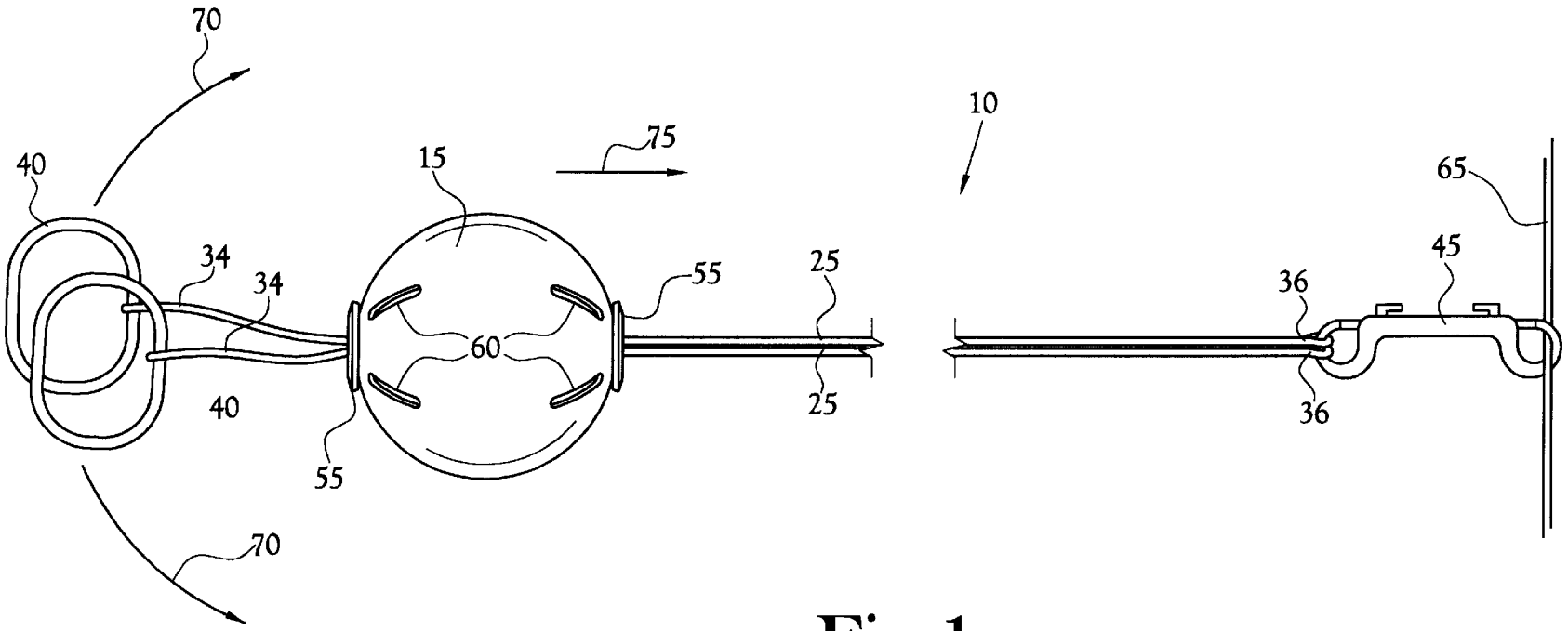
FIG. 1 illustrates a side elevation view of the batting training device of the present invention.
Figure 2:
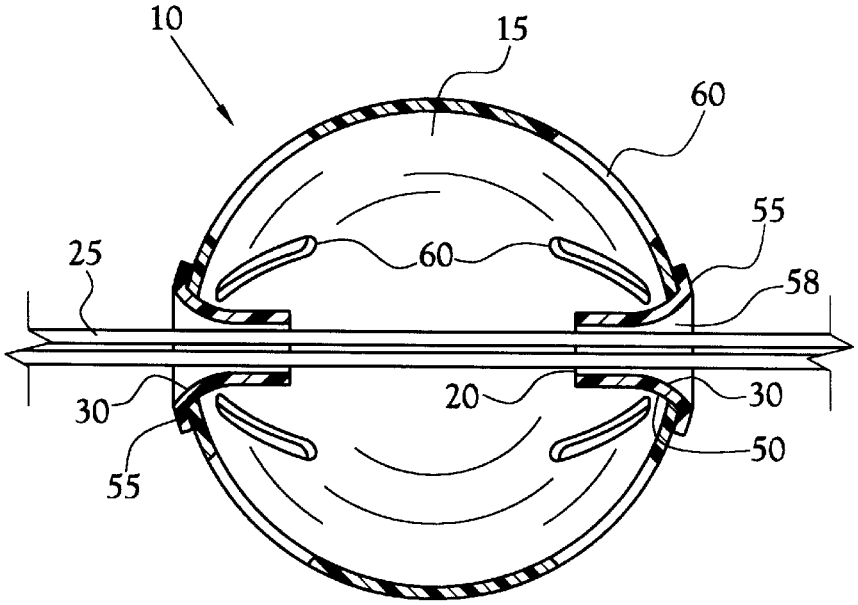
FIG. 2 illustrates a cross-sectional view of the preferred spherical member of the present invention.
Figure 3:
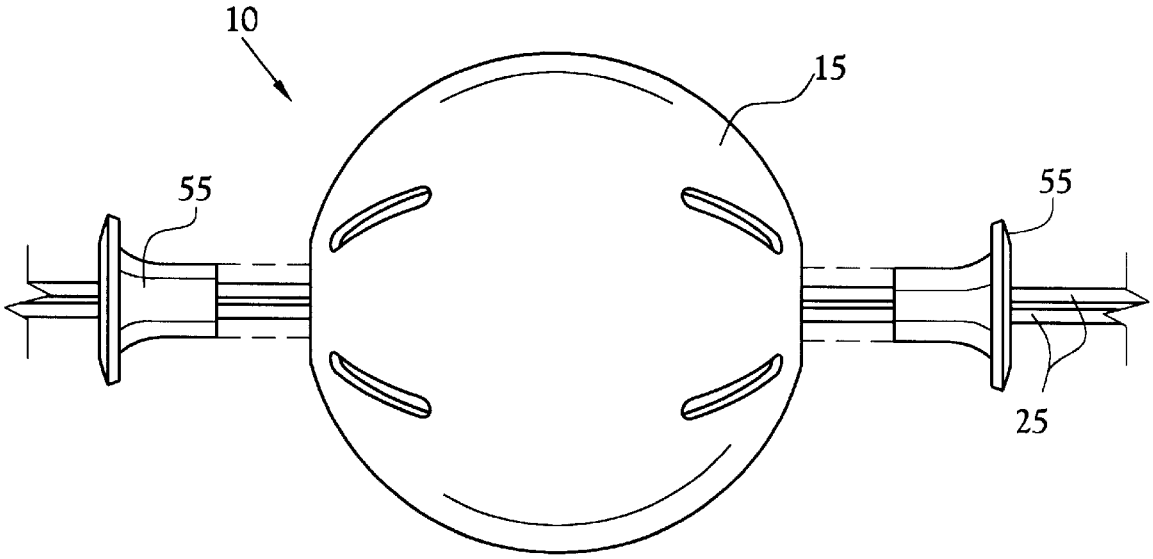
FIG. 3 illustrates an exploded side elevation view of the preferred spherical member of the present invention.

A batting training device, constructed in accordance with the present invention, is illustrated generally as 10 in the figures. The batting training device 10 is defined by a spherical member 15 having a through-opening 20 concentric with a central axis 22 and two elongated tether members 25 that pass through the through-opening 20. The through-opening 20 is preferably provided with a beveled edge 30 at each end. The beveled edge 30 eliminates a sharp edge that could potentially abrade the tethers 25 as the spherical member 15 is in motion.

Figure 5A:
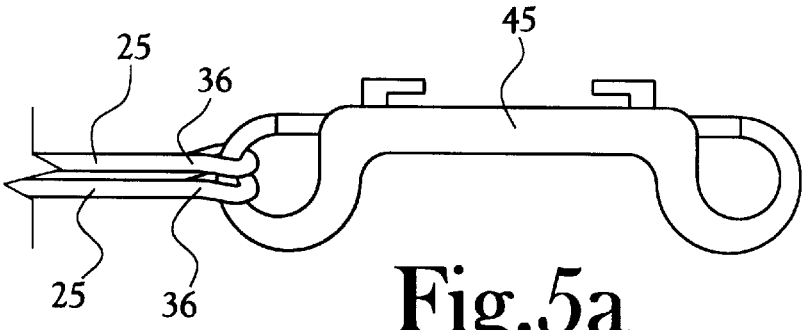
FIG. 5*a* illustrates a side elevational view of the securement member of the present invention used in conjunction with two tethers.
Figure 5B:
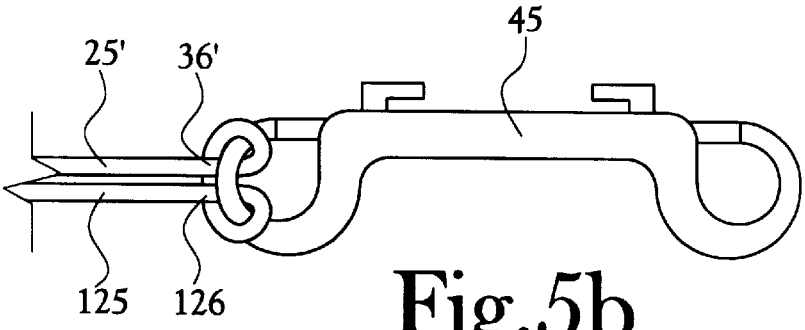
FIG. 5*b* illustrates a side elevational view of the securement member of the present invention used in conjunction with a single tether.

Each elongated tether 25 has a first end 34 secured to a handle 40 and a second end 36 secured to a securement member 45. The handles 40 are provided for being grasped by a coach or a training assistant (not shown). The securement member 45 is provided for securing the batting training device 10 to a stationary object such as a chain-link fence. In one embodiment, illustrated in FIG. 5*a,* second ends 36 of tethers 25 are separate such that tethers 25 are individual tether members. In another embodiment, illustrated in FIG. 5*b,* second ends 36' of tethers 25' are joined together such that tethers 25' are formed from a single cord 125 having a loop 126 disposed proximate the middle of cord 125 for securing cord 125 to securement member 45.

Figure 4:
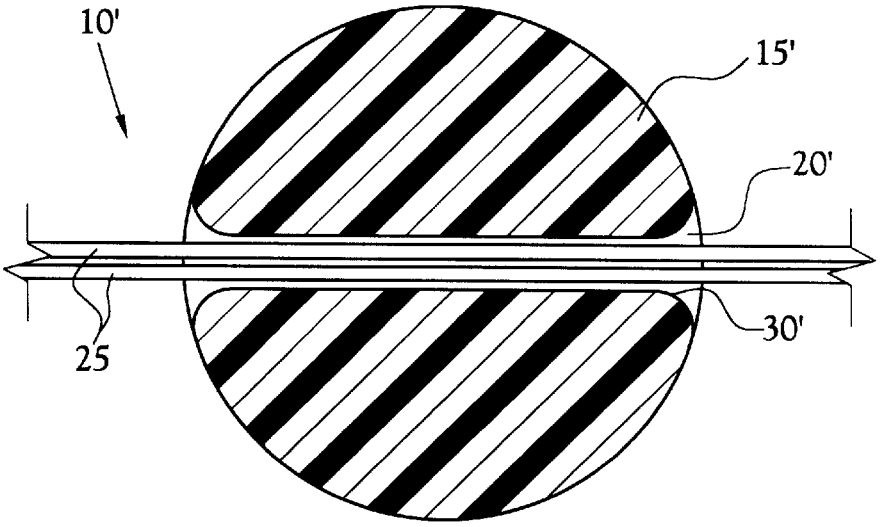
FIG. 4 illustrates a cross sectional view of an alternate embodiment spherical member of the present invention.

In the preferred embodiment of the batting training device 10 spherical member 15 is hollow, is constructed of plastic, and preferably has a plurality of perforations 60 in its surface. Through-opening 20 is provided by oppositely disposed hole members 50. Generally annular plastic inserts 55 are inserted into the hole members 50 to prevent the edge of the hole members 50 from abrading the tethers 25. It will be appreciated that annular plastic inserts 55 each have a corresponding through opening 58 that is concentric with through-opening 20, and that beveled edge 30 is disposed on plastic insert 55. The tethers 25 are provided by two substantially equal lengths of polypropylene cord. Two handles 40 are secured to the two first ends 34. The second ends 36 of tethers 25 is secured to securement member 45, which, in the preferred embodiment is defined a double ended hook, for securing the batting training device 10 to a stationary object 65 such as a chain-link fence. While the preferred spherical member 15 is defined by a perforated, hollow, plastic ball, it will be appreciated by those skilled in the art that, as shown in FIG. 4, an alternate spherical member 15' could be a solid, toroidal member having a through-opening 20' concentric with a central axis. As discussed above, through-opening 20' includes a beveled edge 30'.

In use, batting training device 10 is secured to a stationary object 65. A training assistant, (not shown), grasps the handles 40 and extends the tethers 25 to their full extent. A batter, (not shown), positions herself proximate the stationary object 65, preferably at least a bat's length away from stationary object 65 and takes a batters stance towards the training assistant. The training assistant brings the handles 40 together and declines the tethers 25 thus allowing the spherical member 15 to slide towards the handles 40. The handles are then raised so that the tethers 25 approximate a desired path for a pitched ball. When the batter is ready, the training assistant rapidly displaces the handles 40 away from each other in the direction of arrows 70 thus propelling spherical member 15 towards the batter in the direction of arrow 75. If the batter misses the spherical member 15, the training assistant repeats the above steps. In the event contact is made, the training assistant can stop the return travel of the spherical member by maintaining the displacement of the handles 40 away from each other. By controlling the momentum with which the handles 40 are displaced from each other, the training assistant can control the velocity of the spherical member 15 towards the batter.

From the foregoing description, it will be recognized by those skilled in the art that a training device useful for training a proper bat swing that simulates the correct ball path of a pitched ball and yet doesn't require the ball to be retrieved when the ball is struck or when the ball is missed offering advantages over the prior art has been provided. Specifically, the batting training device of the present invention provides a batting training device that simulates the correct ball path of a pitched ball and that is readily portable and can be secured to a stationary object, such as a chain-link fence. Also, as can be seen from the above description, the present invention provides a batting training device in which a struck ball returns, in controlled fashion, to the training assistant and which allows the training assistant to control the velocity of the simulated pitch.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A batting training device for simulating a pitched ball, said batting training device comprising;

a spherical member having a through-opening concentric with a central axis;

a first and a second elongated tether member extending through said through-opening such that said spherical member is slidably carried by said first and said second elongated tether members, each said first and second tether member having a first end and a second end;

a first handle member secured to said first end of said first elongated tether member;

a second handle member secured to said first end of said second elongated tether member; and a securement member secured to said second ends of said first and said second elongated tether members for releasably securing said batting training device to a stationary object.

2. The batting training device of claim 1 wherein said through opening is provided with at least one beveled edge.

3. The batting training device of claim 1 wherein said first and said second elongated tether members are formed from a single cord having a loop disposed proximate a middle portion of said cord for securing said cord to said securement member.

4. The batting training device of claim 1 wherein said spherical member is defined by a hollow perforated sphere.

5. The batting training device of claim 1 wherein said spherical member is defined by a solid sphere.

6. The batting training device of claim 1 wherein said spherical member is constructed of plastic.

7. The batting training device of claim 4 wherein said through-opening is defined by a pair of oppositely disposed hole members.

8. The batting training device of claim 7 wherein said batting training device further comprises an annular plastic insert engaged with each said hole member, each said annular plastic insert having a through-opening concentric with said oppositely disposed hole members.

9. A batting training device for simulating a pitched ball, said batting training device comprising;

a spherical member having a through-opening concentric with a central axis, wherein said spherical member is defined by a hollow perforated sphere, and wherein said through-opening is defined by a pair of oppositely disposed hole members disposed on said spherical member;

a first and a second elongated tether member extending through said through-opening such that said spherical member is slidably carried by said first and said second elongated tether members, each said first and second tether member having a first end and a second end;

a first handle member secured to said first end of said first elongated tether member;

a second handle member secured to said first end of said second elongated tether member; and a securement member secured to said second ends of said first and said second elongated tether members for releasably securing said batting training device to a stationary object.

10. The batting training device of claim 9 wherein said through opening is provided with at least one beveled edge.

11. The batting training device of claim 9 wherein said first and said second elongated tether members are formed from a single cord having a loop disposed proximate a middle portion of said cord for securing said cord to said securement member.

12. The batting training device of claim 9 wherein said spherical member is constructed of plastic.

13. The batting training device of claim 9 wherein said batting training device further comprises an annular plastic insert engaged with each said hole member, each said annular plastic insert having a through-opening concentric with said oppositely disposed hole members.

* * * * *